United States Patent [19]

Breaz et al.

[11] 4,246,726

[45] Jan. 27, 1981

[54] WINDOW GUIDE ARRANGEMENT

[75] Inventors: Cornell Breaz, Pontiac; Bohdan Kazewych, Union Lake, both of Mich.

[73] Assignee: General Motors Corporation, Detroit, Mich.

[21] Appl. No.: 70,641

[22] Filed: Aug. 28, 1979

[51] Int. Cl.[3] ..... E05F 11/48

[52] U.S. Cl. ..... 49/227; 49/352; 49/360

[58] Field of Search ..... 49/360, 352, 348, 349, 49/325, 227, 374, 375, 350

[56] References Cited

U.S. PATENT DOCUMENTS

| | | | |
|---|---|---|---|
| 3,591,982 | 7/1971 | Nantau | 49/227 |
| 4,004,371 | 1/1977 | Podolan et al. | 49/352 |
| 4,051,632 | 10/1977 | Fukumoto et al. | 49/348 |

*Primary Examiner*—Philip C. Kannan

*Attorney, Agent, or Firm*—Herbert Furman

[57] ABSTRACT

A window guide arrangement for guiding movement of a vehicle window along a curvilinear path defined by a fixed guide member includes a sash plate secured to the window and having a bearing seat molded about a bearing provided with diametrical ribs whereby the bearing seat has grooves which cooperate with the bearing ribs in limiting rotation of the bearing to a plane containing the curvilinear path of movement of the window as the bearing rotates within the seat during movement of the bearing and sash plate along the guide member.

3 Claims, 11 Drawing Figures

WINDOW GUIDE ARRANGEMENT

This invention relates generally to a window guide arrangement and more particularly to a window guide arrangement for guiding movement of a vehicle body window along a curvilinear path.

Guide arrangements for guiding movement of vehicle body windows are well known. Such guide arrangements can include a plurality of pivotally interconnected links which fold and unfold relative to each other as well as various types of slidable connections between a vehicle body window and a fixed guide member.

The guide arrangement of this invention is particularly intended for use with vehicle body windows which move along a curvilinear path between open and closed positions, such as a curvilinear path defined by a fixed guide tube. In the preferred embodiment, the guide arrangement includes a window sash plate of molded plastic material provided with a spherical bearing which receives the guide tube therethrough and rotates in the plane of the path of movement within an integrally molded bearing seat of the sash plate to accommodate relative movement between the window and guide tube while maintaining the movement of the window along the path defined by the guide tube.

The sash plate is molded about the bearing and the bearing provides the pattern for cooperating ribs and grooves on the bearing and bearing seat limiting rotation of the bearing to a plane containing the path of movement of the window as defined by the fixed guide tube. The bearing is molded of plastic material and during such molding, diametrically opposite ribs are formed on the bearing as flash. Normally, flash is minimized and removed if present. However, in this invention, the flash is not removed and if necessary, may be deliberately provided in order to ensure that the ribs result from the molding process. After the bearing is formed, it is accurately located in the sash plate mold, and the sash plate is then molded about the bearing. During this molding process, the bearing seat is molded about the bearings so that the bearing becomes part of the sash plate. The ribs form grooves in the bearing seat, and the ribs and grooves limit the rotation of the bearing relative to the bearing seat to a predetermined plane. By accurately locating the bearing in the mold, the ribs and grooves of the bearing and bearing seat are formed so as to be located in the plane of the path of movement of the window when the sash plate is mounted on the window and slidably receives the fixed guide tube. Thus, the guide arrangement of this invention ensures that the tilting movement of the window and sash plate relative to the bearing during movement of the window occurs in a predetermined plane. The sash plate further includes a pair of integral ribs which define therebetween a slot slidably receiving the guide tube so as to guide tilting movement of the sash plate relative to the guide tube and cooperate with the ribs of the bearing and the bearing of plastic material which forms the pattern for the bearing seat of a sash plate molded about the bearing to ensure that the bearing and the bearing seat have a predetermined relationship. Another feature is that the bearing is molded with integral coplanar diametrical ribs which provide integral grooves in the bearing seat when the bearing seat is molded about the bearing to ensure that relative movement of the bearing and bearing seat occurs in a predetermined plane containing the ribs and grooves. A further feature is that the sash plate is adapted to be mounted to a vehicle window and the bearing receives a fixed guide tube therethrough which defines the path of movement of the window, with such path being located in the plane of the ribs and grooves. Yet another feature is that the sash plate includes an additional guide ensuring relative movement of the sash plate and the guide tube in the predetermined plane. Yet a further feature is that the additional guide includes a pair of integrally molded ribs on the sash plate which straddle the guide tube and cooperate with the ribs and grooves of the bearing and bearing seat respectively in limiting movement of the sash plate and the window relative to the guide tube to the predetermined plane as the window moves between open and closed positions.

These and other features of the window guide of this invention will be readily apparent from the following specification and drawings wherein.

Figure 1:
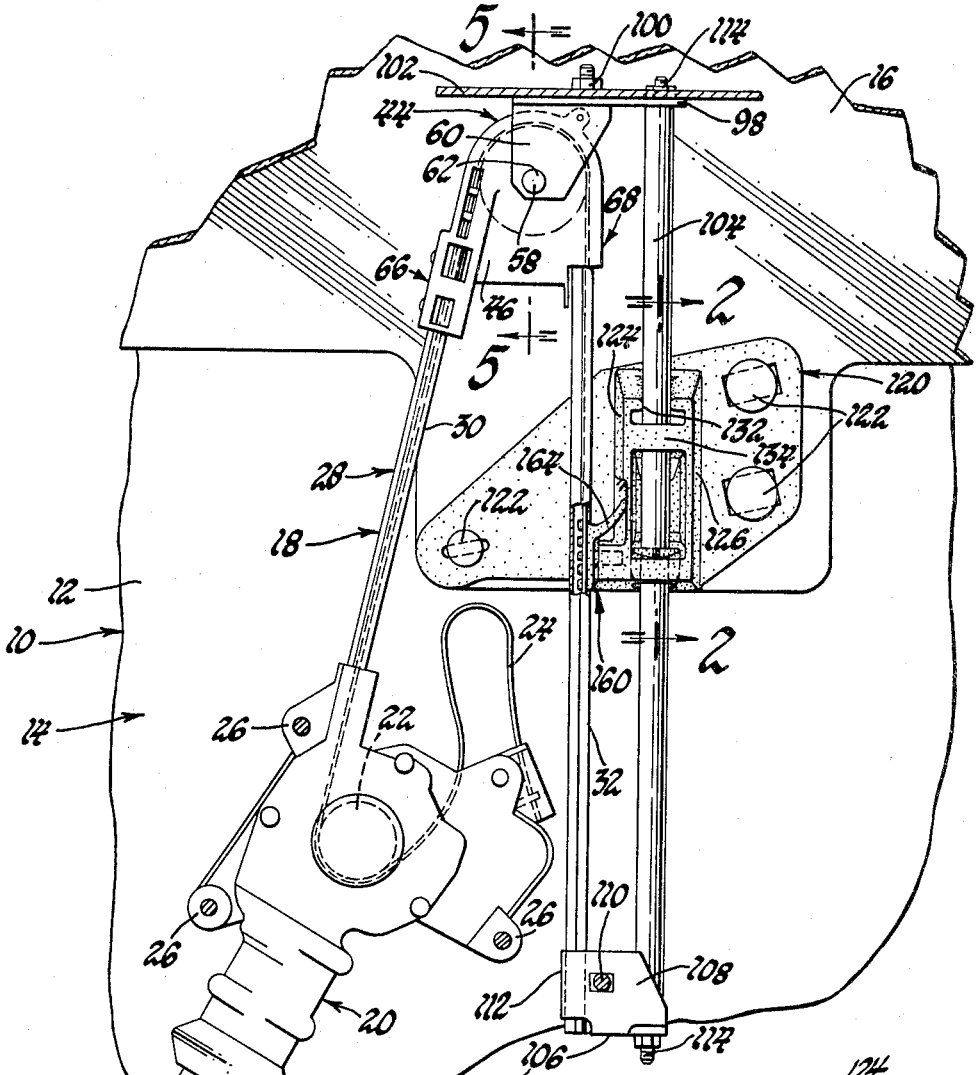
FIG. 1 is a partial view of a vehicle body window guided in its movement along a curvilinear path by a guide arrangement according to this invention.

Referring now particularly to Figure 1 of the drawings, a vehicle body door designated generally 10 includes a door outer panel 12 and a door inner panel, not shown, which is spaced inboard thereof and defines therewith a window receiving well 14. A vehicle window designated generally 16 moves between a closed position, as shown, and an open position, not shown, wherein the window is located within the well 14. When the window is in closed position, it seals against a conventional upper door window frame or up against the roof rail and pillar structure of the body. Since the door 10 is conventional, further details are not necessary to an understanding of this invention.

Figure 5:
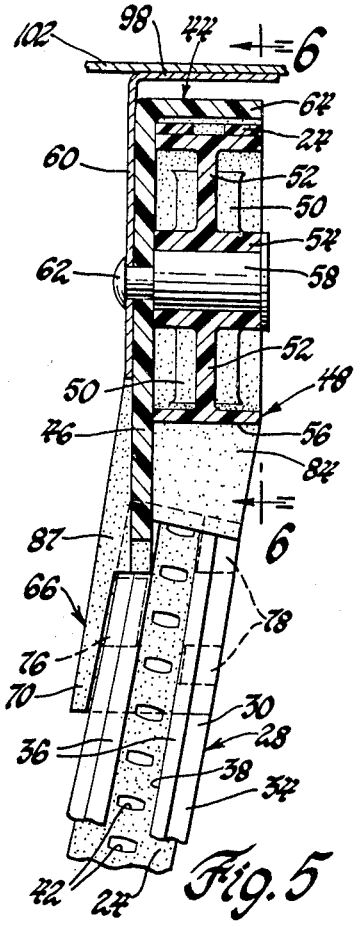
FIG. 5 is an enlarged sectional view taken generally along the plane indicated by line 5—5 of FIG. 1.

A tape drive mechanism 18 is mounted within the well 14 and operatively connected to the window 16 for moving the window between its open and closed positions. The mechanism 18 includes a drive unit 20 which is shown as a power drive unit including a conventional electric motor and reduction gear unit driving an output cog 22 for moving a perforated tape 24 which is wider than normal. The unit 20 is a selfcontained module which includes a number of mounting pads 26 seating against the door inner panel and secured thereto in a conventional manner. The tape 24 moves in a track 28 which includes a first or forward angularly extending section 30 and a second or rearward vertically extending section 32. The track 28 is of conventional structure and, as shown in FIG. 10, includes a generally C-shape body portion 34 having the reverse bent edges 36 thereof defining a longitudinally open slot 38 which is located generally opposite to a generally U-shaped reinforcement portion 40 formed integrally with the body portion. As shown, the tape 24 moves within the body portion and includes equally spaced perforations 42 which connect the tape to the output cog 22 of the drive unit and also provide for connection of the tape to the window 16 as will be described. The adjacent ends of the track sections 30 and 32 are interconnected by a housing unit 44 best shown in FIGS. 1, 5, 6, 8 and 9. The housing unit is generally integrally formed of molded plastic material and includes a planar inner wall 46 having rotatably secured thereto a roller 48. As shown in FIG. 5, the roller 48 is likewise formed of molded plastic material and includes ribs 50 and webs 52 which integrally connect the hub portion 54 of the roller with the outer tire portion 56, having a width generally the same as that of tape 24. A headed stud 58 rotatably mounts the roller 48 and in turn is fixed to wall 46 and to a mounting bracket 60 by heading over a reduced diameter portion 62 of the stud. An apertured ear 63 of wall 46 is riveted to bracket 60. The housing unit 44 further includes an integral outer peripheral wall 64 which merges into integral forward and rearward mounting sections 66 and 68 which respectively receive and mount the upper ends of track sections 30 and 32. The lower end of track section 30 is secured to unit 20 and the lower end of track section 32 is secured to door 10 in a manner to be described.

Figure 6:
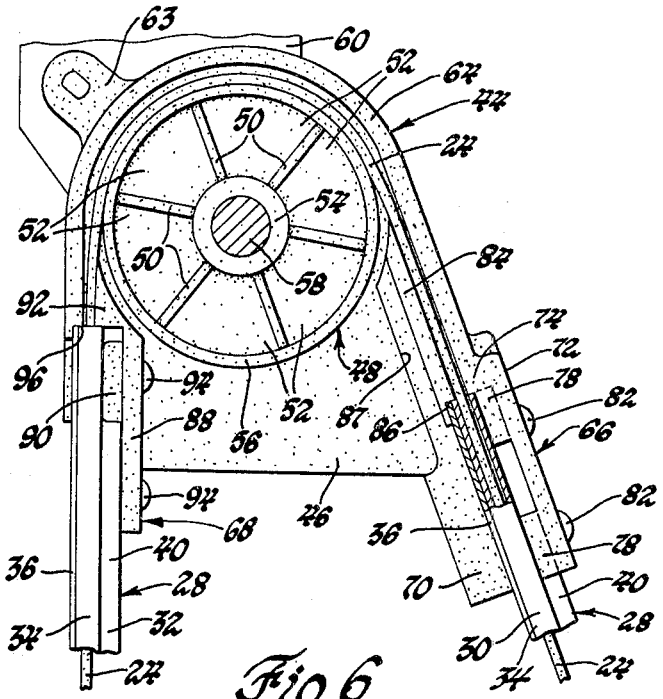
FIG. 6 is a view taken generally along the plane indicated by line 6—6 of FIG. 5.
Figure 9:
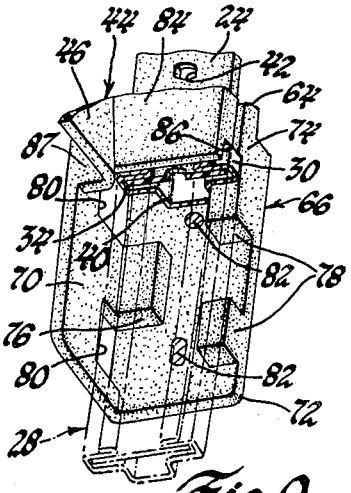
FIG. 9 is an enlarged partially broken away perspective view of a portion of FIG. 6.
Figure 10:
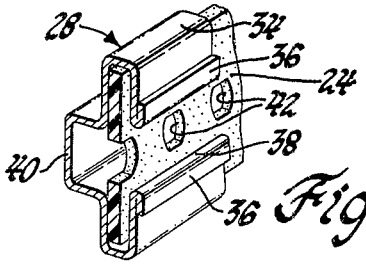
FIG. 10 is an enlarged perspective view of a portion of FIG. 1.

As shown in FIGS. 5, 6 and 9, the forward section 66 includes a slightly arcuate inner wall 70 which extends angularly to and merges into the inner wall 46 of the housing unit 44 and also into the outer peripheral wall 64 of the unit. The section 66 further includes an outer peripheral wall 72 which extends laterally to wall 70 and is joined to wall 64 by an offset thicker wall 74. An integral mounting block 76 is provided at the juncture of walls 70 and 72 and integral upper and lower mounting blocks 78 are provided at the edge of wall 64, the upper block being integral with the offset wall 74. Apertures 80 are provided in the wall 70 for manufacturing purposes. The inner side walls of the mounting blocks 76 and 78 define an open discontinuous longitudinal slot which is respective to the longitudinal shape of the reinforcement portion 40 of the track section 30 and receives such portion as shown in phantom in FIG. 9 with the base of the reinforcement portion seating on wall 72 and the sides thereof seating against the inner side walls of the mounting blocks. The end edge of the reinforcement portion 40 abuts the offset wall portion 74 to thereby provide a limit stop limiting the distance of insertion of the track section 30 within mounting section 66. One or more rivets 82 secure the reinforcement portion 40 to the wall 72 to thereby fix the track section 30 to the mounting section 66. An integral rib 84 extends laterally from the wall 70 and is spaced from the wall 64 a distance slightly greater than the thickness of the tape 24 as shown in FIG. 6 to thereby cooperatively provide a guide slot for the tape 24 to ensure tangential engagement of the tape and the tire portion 56 of roller 48. The lower edge of wall 84 is cut away at 86 for engagement by the end edges of the outer legs and edges 36 of the body portion 34 of the track section, while the end edges of the inner legs of the body portion engage wall 74. Thus, the upper end of the track section 30 is positively longitudinally located within the mounting section 66 by wall 74 and cutout 86. The cutout 86 and the upper block 78 positively laterally locate the upper end of the track section 30. A lateral wall 87, FIG. 5, joins walls 70 and 46 inwardly of rib 84.

In the structure shown, track section 30 is longitudinally arcuate and slightly convex outboard of door 10 although laterally planar. Wall 70 conforms to the shape of the upper end portion of the track section as shown in FIG. 5 and the discontinuous slot defined by blocks 76 and 78 also conforms to the same shape, as shown in FIG. 5. Wall 72 and rib 84 conform to this shape as well. Thus, the mounting section 66 is respective to track section 30 and ensures assembly of a correctly shaped track section to the housing unit 44 as well as ensuring that the opening of the upper end of the track section is aligned with the guide slot provided by rib 84 and wall 64 to ensure tangential engagement of tape 24 and the tire portion 56 of roller 48.

Figure 8:
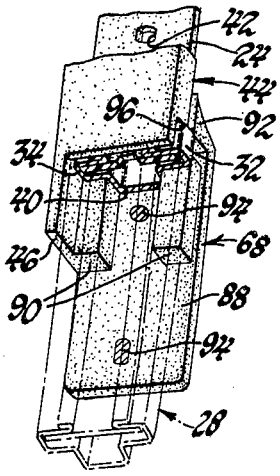
FIG. 8 is an enlarged partially broken away perspective view of a portion of FIG. 6.

The rearward mounting section 68, FIGS. 6 and 8, includes a lateral wall 88 which is formed integral with the wall 46. As shown in FIG. 8, the wall 88 includes a pair of mounting blocks 90, one being located adjacent the free edge thereof and the other being located at the juncture of wall 88 with the wall 46. A lateral rib 92 of wall 46 is integrally connected to the wall 88 and spaced from the wall 64 to provide a guide slot for the tape 24 to ensure tangential engagement of the tape and the tire portion 56 of the roller 48. The blocks 90, as shown in FIG. 8, define an open longitudinal slot which is respective to the longitudinal shape of the reinforcement portion 40 of track section 32 for receipt thereof upon insertion of the track section 32 within the mounting section 68. The reinforcement portion is secured to wall 88 by rivets 94. The track section is located relative to the wall by having the upper end edge of the reinforcement portion 40 engage the rib 92 as shown in FIG. 8, and having the end edge of the body portion engage a cut-away portion 96 of wall 64. In the specific embodiment shown, the track section 32 is laterally planar and longitudinally arcuate transversely of door 10 and conforms to the path of movement of the window 16. The mounting blocks 90 are shaped relative to each other so as to receive only a track section of this longitudinally arcuate shape.

The height of blocks 76 and 78 laterally of wall 64 and likewise the height of blocks 90 laterally of wall 88 is set such that the reinforcement portions 40 of the respective track sections engage the walls 64 and 88 while the body portions 34 seat on the blocks. This accurately positions the respective track sections relative to the respective guide slots and ensures that the tape 24 moves smoothly into and out of the track sections as well as moving smoothly into and out of tangential engagement with the tire portion 56 of the roller 48.

While both track sections are longitudinally arcuate and open in the same direction, they are misaligned longitudinally of the body. The mounting sections 66 and 68 ensure tangential engagement of tape 24 and roller 48 despite this misalignment. The tape 24 is flexible laterally of the plane thereof but rigid longitudinally in the plane thereof. Thus, depending on the shape of the track sections and the misalignment thereof, the tape 24 may completely overlap the tire portion of the roller or only partially overlap such tire portion. In either event, the tape will drive the roller 48 as it moves smoothly into and out of tangential engagement therewith and moves smoothly without binding in the track sections.

As shown in FIGS. 1 and 5, the bracket 60 includes a lateral flange 98 which overlies the housing unit 44 and is secured at one or more places 100 to a lateral wall 102 of the door inner panel.

Figure 2:
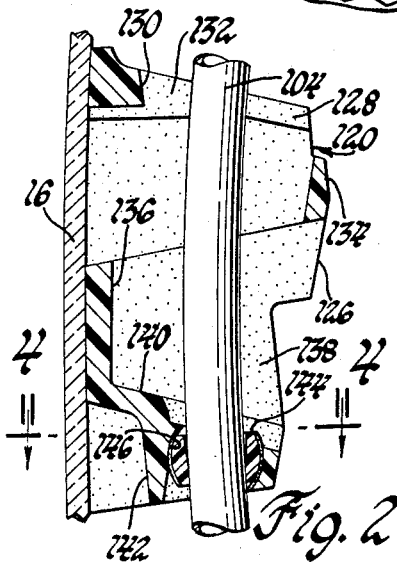
FIG. 2 is an enlarged sectional view taken generally along the plane indicated by line 2—2 of FIG. 1.

A hollow guide tube 104, FIG. 1, extends between the flange 98 and a lateral flange 106 of a lower bracket 108 which is conventionally secured to the door inner panel at 110. The lower portion of the track section 32 is welded to a lateral flange 112 of the bracket 108. The guide tube 104 is longitudinally arcuate transversely of the door 10 as shown in FIG. 2 and generally follows the path of movement of the window 16. In order to mount the guide tube to the flanges 98 and 106, a pair of ribbed plugs 114 are force fitted into the ends of the guide tube and the threaded ends thereof are bolted to the respective brackets.

The guide arrangement of this invention includes a sash plate 120 of molded plastic material which is conventionally secured at 122 to the window 16. The center portion of the sash plate includes a pair of generally parallel walls 124 and 126, the upper edges of which are provided with integral lateral flanges 128 joined by an integral flange 130 and defining a guide tube receiving slot 132. The walls 124 and 126 are further interconnected by webs 134 and 136.

Figure 7:
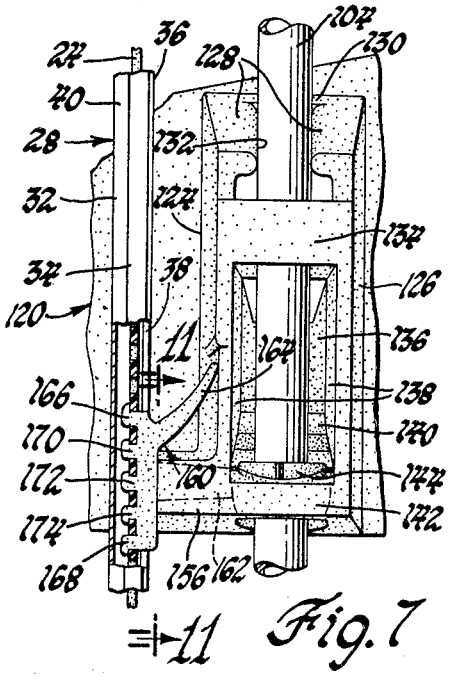
FIG. 7 is an enlarged view of a portion of FIG. 1.

The portions 138 of the walls below web 134 are thickened and taper toward each other and web 136 as shown in FIGS. 2 and 7. The portions 138 are interconnected by a lower stepped wall 140 and a bushing seat portion 142. A truncated spherical bushing 144 is seated within the bushing seat 146 of portion 142 in a manner to be described.

Figure 3:
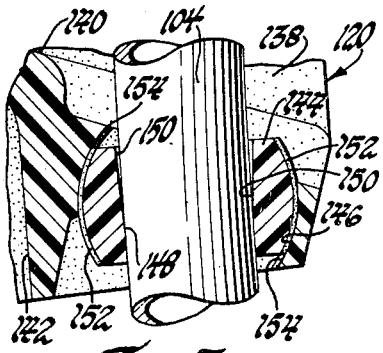
FIG. 3 is an enlarged view of a portion of FIG. 2.
Figure 4:
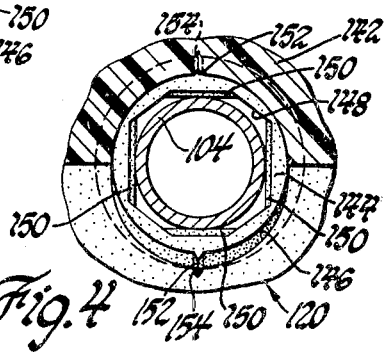
FIG. 4 is an enlarged sectional view taken generally along the plane indicated by line 4—4 of FIG. 2.

As shown in FIGS. 3 and 4, the bushing 144 includes a central octagonal shape aperture 148 having juxtaposed pairs of walls 150 thereof tapering inwardly of the bushing and toward each other for approximately one-half the vertical extent thereof. The bushing 144 is molded of suitable self-lubricating plastic material, such as nylon, and is formed in a two part mold such that the parting lines of the mold leave a pair of axial flashes or ribs 152 on the outer side thereof. The sash plate 120 is integrally molded of plastic material. The molded bushing 144 is accurately placed in the mold transverse to the plane of the sash plate before the sash plate is molded. Thus, when the sash plate is molded, the bushing is integrally molded in the sash plate, and the seat 146 of the portion 142 is thereby provided with shallow transverse grooves 154 which limit rotation of the bushing in a plane transverse of the sash plate. As shown, the guide tube 104 extends through the slot 132 and through the bushing 144. Since the sash plate is fixed to the window 16, the sash plate and window move as a unit relative to the guide tube and bushing 144 as the bushing rotates within the seat 16. The slot 132 has a width generally equal to the diameter of the guide tube and cooperates with the movement of bushing 144 within seat 146, as limited by ribs 152 and grooves 154, in ensuring that the window will follow the precise path dictated by the longitudinal curvature of the guide tube and will move laterally of the body or inwardly and outwardly as it moves between open and closed positions along this arcuate path.

The window is stabilized by the conventional sealing strips which are mounted on the door inner and outer panels at the upper opening of well 14 and slidably and frictionally engage the inner and outer surfaces of the window. Additional guides, if necessary, may also be used on the side walls of well 14, and a lateral stabilizer as shown in U.S. Ser. No. 950,629, Podolan et al, filed Oct. 12, 1978 and assigned to the assignee of this invention, may also be used.

As shown in FIGS. 3 and 4, the tapered walls 150 provide only four contact lines between bushing 144 and the guide tube 104 to reduce friction to a minimum. These lines of contact extend for approximately one-half of the depth of bushing 144 and are particularly important in permitting easy and smooth window movement under cold temperature conditions.

Figure 11:
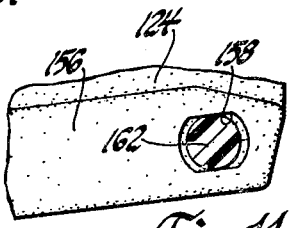
FIG. 11 is an enlarged sectional view taken generally along the plane indicated by line 11—11 of FIG. 7.

As shown in FIGS. 7 and 11, the wall 124 includes a laterally extending thickened rib 156 which is provided with an elongated opening 158 having planar upper and lower walls which taper slightly toward each other inwardly of the opening. A drive block 160 includes a slightly tapered drive pin 162 which is received within the opening 158 in tangential engagement with the upper and lower walls thereof for movement relative to such walls and inwardly and outwardly of the opening. The drive block 160 further includes an arcuately tapered finger 164 which engages the wall 124 for a purpose to be described, as well as a plurality of vertically disposed barbs which hook within the perforations 42 of tape 24 to drivingly connect tape 24 to the window 16 and sash plate 120. As best shown in FIG. 7, the vertically uppermost barb 166 faces barb 174 faces downwardly. The barbs 166 through 174 are formed integrally with the drive block 160 and hook into the perforations 42 of the tape 24 through the slotted opening 38 of the track section 32. The width of the drive block is, of course, less than the width of the opening 38 so that the drive block and tape move relative to the track section 32 without interference.

The barbs and their integral bar extensions connect the drive block to the tape and prevent the drive block from pulling out of driving connection to the tape under the various loads imposed on the drive block during movement of the window between its open and closed positions. Since the uppermost barb 166 of the drive block carries the most load, it has the longest barb extension. The lowermost barb 168 carries a lesser load and therefore has a shorter barb extension than that of barb 166. The intermediate barbs 170, 172 and 174 face oppositely of each other, but the direction in which they face and the length of their barb extensions is not critical.

During movement of the window, the guide tube 104 and the track section 32 tend to separate or move apart longitudinally of the body. The pin 162 of the drive block and the opening 158 of the sash plate permit this separation of the guide tube and the track section 32 while still maintaining a drive connection between the sash plate and tape 24. The reaction of the arcuate finger 164 against the wall 124 controls pivoting movement of the drive block relative to the sash plate in the plane of the drawings or in a plane longitudinally of the body.

It will be noted that the housing unit 44 permits the track section 32 to open directly to the guide tube so that the drive block 160 can directly connect the tape 24 and the sash plate. This reduces friction losses and increases the efficiency of the drive mechanism over known drive mechanisms wherein the track section 32 would open away from the guide tube and require the drive block to encircle the track section so as to be connected to tape 24.

Thus this invention provides an improved window guide arrangement.

The embodiments of the invention in which an exclusive property or privilege is claimed are defined as follows:

1. In combination with a support, a window movable along a predetermined non-linear path relative to the support, and drive means for moving the window, the improvement comprising, a driven member interconnecting the drive means and the movable window and including a spherical type bearing seat of molded plastic material, a spherical type bearing of molded plastic material having an axial aperture therethrough, cooperating integral rib means on the bearing and respective integral groove means in the bearing seat limiting movement of the bearing relative to the bearing seat to a plane containing the path of movement of the movable window, the bearing seat being molded about the bearing whereby the bearing ribs provide the pattern for the bearing seat grooves during the molding of the bearing seat, and a window guide member fixed to the support and defining the predetermined path of movement of the window, the guide member being received through the axial aperture of the bearing and rotating the bearing relative to the bearing seat in the plane of the path of movement as the bearing moves along the path of movement defined by the guide member.

2. In combination with a support, a window movable along a predetermined non-linear path relative to the support, and drive means for moving the window, the improvement comprising, a driven member interconnecting the drive means and the movable window and including a spherical type bearing set of molded plastic material, a spherical type bearing of molded plastic material having an axial aperture therethrough, cooperating integral rib means on the bearing and respective integral groove means in the bearing seat limiting movement of the bearing relative to the bearing seat to a plane containing the path of movement of the movable window, the bearing seat being molded about the bearing whereby the bearing ribs provide the pattern for the bearing seat grooves during the molding of the bearing seat, an elongated window guide fixed to the support and defining the predetermined path of movement of the window, the guide being received through the axial aperture of the bearing and rotating the bearing relative to the bearing seat in the plane of the path of movement as the bearing moves along the path of movement defined by the guide, and guide means on the driven member laterally slidably embracing the window guide to constrain the driven member for movement in the plane of the path of movement.

3. In combination with a support, a window movable along a predetermined non-linear path relative to the support, and drive means for moving the window, the improvement comprising, a driven member interconnecting the drive means and the movable window and including a spherical type bearing seat of molded plastic material, a spherical type bearing of molded plastic material having a multi-sided axial aperture therethrough, cooperating integral rib means on the bearing and respective integral groove means in the bearing seat limiting movement of the bearing relative to the bearing seat to a plane containing the path of movement of the movable window, the bearing seat being molded about the bearing whereby the bearing ribs provide the pattern for the bearing seat grooves during the molding of the bearing seat, and an elongated tubular window guide member fixed to the support and defining the predetermined path of movement of the window, the guide member being received through the axial aperture of the bearing and bearing against certain of the sides thereof to reduce friction therebetween as the bearing moves along the guide member and rotates relative to the bearing seat in the plane of the path of movement of the window.

* * * * *

UNITED STATES PATENT AND TRADEMARK OFFICE

CERTIFICATE OF CORRECTION

PATENT NO. : 4,246,726

DATED : January 27, 1981

INVENTOR(S) : Cornell Breaz, Bohdan Kazewych

It is certified that error appears in the above—identified patent and that said Letters Patent is hereby corrected as shown below:

Column 1, line 59, after "and the" insert -- grooves of the bearing seat in ensuring that the window tilts relative to the guide tube in a predetermined manner.

Therefore one feature of this invention is that it provides an improved window guide arrangement which includes a molded --.

Column 5, line 53, "16" should read -- 146 --.

Column 6, line 26, after "166 faces" insert -- upwardly and has the longest barb extension of any of the barbs. The vertically lowermost barb 168 faces downwardly and has a shorter barb extension than that of barb 166. The intermediate barbs 170 and 172 face upwardly while the penultimate --.

Column 7, line 31, "set" should read -- seat --.

Signed and Sealed this

*Twenty-fourth* Day of *November 1981*

[SEAL]

*Attest:*

GERALD J. MOSSINGHOFF

*Attesting Officer*

*Commissioner of Patents and Trademarks*